US012297847B1

(12) United States Patent
Cao et al.

(10) Patent No.: US 12,297,847 B1
(45) Date of Patent: May 13, 2025

(54) NOISE-REDUCING AND NONUNIFORM TIP CLEARANCE STRUCTURE OF CENTRIFUGAL COMPRESSOR

(71) Applicant: Harbin Engineering University, Harbin (CN)

(72) Inventors: Yipeng Cao, Harbin (CN); Shaoran Du, Harbin (CN); Chen Liu, Harbin (CN); Yao Song, Harbin (CN); Jie Yang, Harbin (CN); Xiaochen Zhao, Harbin (CN); Jie Guo, Harbin (CN); Xinyu Zhang, Harbin (CN)

(73) Assignee: Harbin Engineering University, Harbin (CN)

( * ) Notice: Subject to any disclaimer, the term of this patent is extended or adjusted under 35 U.S.C. 154(b) by 0 days.

(21) Appl. No.: 18/942,128

(22) Filed: Nov. 8, 2024

(30) Foreign Application Priority Data

May 9, 2024 (CN) ..... 202410564485.0

(51) Int. Cl.
*F04D 29/66* (2006.01)
*F04D 17/10* (2006.01)
*F04D 29/28* (2006.01)

(52) U.S. Cl.
CPC ..... *F04D 29/666* (2013.01); *F04D 17/10* (2013.01); *F04D 29/284* (2013.01)

(58) Field of Classification Search
CPC ..... F04D 29/666; F04D 29/667; F04D 17/10; F04D 29/284
See application file for complete search history.

(56) References Cited

U.S. PATENT DOCUMENTS 7,189,059 B2 * 3/2007 Barton ..... F04D 29/685 415/191
2024/0410392 A1 * 12/2024 Mathuria ..... F04D 29/526

FOREIGN PATENT DOCUMENTS

CN 116467812 A 7/2023

OTHER PUBLICATIONS

Notification to Grant Patent Right for Invention in Chinese Application No. 202410564485.0, mailed Nov. 7, 2024 (3 pages). (Translation attached).
First Office Action in Chinese Application No. 202410564485.0, mailed Sep. 25, 2024 (10 pages). (Translation attached).
Liu Fang et al., Influence of tip gap form on aerodynamic performance of cold compressor, *Cryogenics and Superconductivity*, No. 8, pp. 49 to 57, Aug. 2021 (9 pages).

* cited by examiner

*Primary Examiner* — Sabbir Hasan
(74) *Attorney, Agent, or Firm* — Nixon Peabody LLP

(57) ABSTRACT

A noise-reducing and nonuniform tip clearance structure of centrifugal compressor is provided, which includes a compressor impeller body and a compressor impeller shroud. The compressor impeller shroud is circumferentially wrapped outside the compressor impeller body, and multiple impeller blade bodies are uniformly arranged in a circumferential direction of the compressor impeller body. A clearance between an impeller tip meridian line of the impeller blade body and an impeller shroud meridian line on the compressor impeller shroud is an impeller tip clearance. The impeller tip clearance gradually decreases in a direction from a leading edge to a trailing edge of the impeller blade body, and a change rate of the impeller tip clearance in the direction from the leading edge to the trailing edge of the impeller blade body also gradually decreases.

2 Claims, 6 Drawing Sheets

NOISE-REDUCING AND NONUNIFORM TIP CLEARANCE STRUCTURE OF CENTRIFUGAL COMPRESSOR

CROSS-REFERENCE TO RELATED APPLICATION

This patent application claims the benefit of and priority to Chinese Patent Application No. 202410564485.0, filed with the Chinese Patent Office on May 9, 2024, which is hereby incorporated by reference herein in its entirety.

TECHNICAL FIELD

The present disclosure relates to the technical field of centrifugal compressors, and in particular to a noise-reducing and nonuniform tip clearance structure of centrifugal compressor.

BACKGROUND

Turbocharging technology is widely used in the field of marine low-speed diesel engines due to its advantages such as energy saving, noise reduction and economic improvement. However, with the development of turbocharger centrifugal compressors towards high pressure ratio and large flow rate, aerodynamic noise has become a key factor restricting the development of the turbocharger centrifugal compressors.

The maximum sound power of aerodynamic noise of the centrifugal compressor mainly occurs in the impeller. For a semi-open centrifugal compressor, the tip clearance structure between the impeller tip and the impeller shroud has a great influence on the aerodynamic noise. Due to the existence of the tip clearance structure, tip clearance leakage vortex will be induced in an internal passage of the compressor, and the leakage vortex will interact with the secondary flow in the passage and the after body jet-wake, to directly aggravate the internal flow loss of the impeller and make the flow situation in the impeller passage more complicated, resulting in the increase of rotating noise and vortex noise of the centrifugal compressor.

At present, the tip clearance generally employs a uniform tip clearance and a tip clearance with linear change from the leading edge to the trailing edge, and most researchers are concerned about the influence of the tip clearance structure on the aerodynamic performance of the compressor, and there is a lack of research on improvement of aerodynamic noise by tip clearance. However, the existing uniform tip clearance has an adverse effect on the compressor, mainly because of the pressure difference between two sides of the impeller blade, which may produce radial backflow from the trailing edge to the leading edge of the blade along the clearance and cross-blade circumferential clearance flow between adjacent passages. These flows lead to the aggravation of the flow loss inside the impeller (the larger the tail clearance, the greater the flow loss), which makes the flow situation in the impeller passage more complicated and leads to the increase of the rotating noise and vortex noise of the centrifugal compressor.

Therefore, there is an urgent need of a noise-reducing and nonuniform tip clearance structure of centrifugal compressor to solve the problem above.

SUMMARY

An objective of the present disclosure is to provide a noise-reducing and nonuniform tip clearance structure of centrifugal compressor to solve the problems in the prior art, which can effectively solve aerodynamic noise caused by an impeller tip clearance.

To achieve the objective above, the present disclosure employs the following technical solution.

A noise-reducing and nonuniform tip clearance structure of centrifugal compressor includes a compressor impeller body and a compressor impeller shroud. The compressor impeller shroud is circumferentially wrapped outside the compressor impeller body, and multiple impeller blade bodies are uniformly arranged in a circumferential direction of the compressor impeller body. A clearance between an impeller tip meridian line of the impeller blade body and an impeller shroud meridian line on the compressor impeller shroud is an impeller tip clearance. The impeller tip clearance gradually decreases in a direction from a leading edge to a trailing edge of the impeller blade body, and a change rate of the impeller tip clearance in the direction from the leading edge to the trailing edge of the impeller blade body also gradually decreases.

In some embodiments, the multiple impeller blade bodies include multiple main blade bodies and multiple splitter blade bodies, and the multiple main blade bodies and the multiple splitter blade bodies are distributed in a staggered manner.

In some embodiments, the impeller tip clearance needs to satisfy a formula $C=(1+H^4)T$;

in the formula, C is a dimensionless tip clearance height, $$C = \frac{X}{X_L}$$

or $$C = \frac{Y}{Y_L},$$

X is a height of the impeller tip clearance at any normal position of a main blade meridian line, and Y is a height of the impeller tip clearance at any normal position of a splitter blade meridian line; His a dimensionless blade height coefficient, $$H = \frac{h - H_T}{H_L - H_T}$$

and $H \in [0,1]$, 0 and 1 denote a blade trailing edge and a blade leading edge, respectively; h is a blade height at any normal position between blade meridian lines, $H_L$ is a height of a leading-edge blade, and $H_T$ is a height of a trailing-edge blade; and T is a ratio of a trailing-edge tip clearance to a leading-edge tip clearance, $$T = \frac{X_T}{X_L} = \frac{Y_T}{Y_L},$$

$X_L$ is a leading-edge tip clearance of the main blade, $X_T$ is a trailing-edge tip clearance of the main blade, $Y_L$ is a leading-edge tip clearance of the splitter blade, and $Y_T$ is a trailing-edge tip clearance of the splitter blade.

In some embodiments, the leading-edge tip clearance $X_L$ of the main blade is equal to 0.975 mm, and the trailing-edge tip clearance $X_T$ of the main blade is equal to 0.65 mm. The leading-edge tip clearance $Y_L$ of the splitter blade is equal to 0.975 mm, and the trailing-edge tip clearance $Y_T$ of the splitter blade is equal to 0.65 mm.

In some embodiments, an exponent of the dimensionless blade height coefficient is n, where n is greater than or equal to 4.

In some embodiments, the compressor impeller body includes a compressor impeller hub, a hub rotating shaft is fixed to the center of the compressor impeller hub, a volute body is arranged outside the compressor impeller shroud, and the compressor impeller shroud and the volute body are in an integrated structure. A compressor volute passage is arranged in the volute body. A diffuser passage is arranged between the compressor volute passage and the compressor impeller body, and a diffuser blade is arranged in the diffuser passage.

Compared with the prior art, the present disclosure has the following technical effects.

1. The noise-reducing and nonuniform tip clearance structure of centrifugal compressor provided by the present disclosure can reduce aerodynamic noise of a centrifugal compressor on the basis of satisfying the aerodynamic performance requirements. Further, on the basis that the overall clearance of the nonuniform impeller tip clearance is larger than the traditional uniform tip clearance, the aerodynamic performance changes littler, a pressure ratio and isentropic efficiency are reduced by no more than 2% under a design working condition. At the same acoustic monitoring point, the sound pressure level of the structure provided by the present disclosure is smaller than that of the uniform tip clearance, and the average overall sound pressure level at the monitoring point is reduced by about 2 dB.
2. According to the present disclosure, the impeller tip clearance has a larger change rate when close to the blade leading edge and has a smaller change rate when close to the blade trailing edge. Such a distribution can remain a trailing-edge portion at a low impeller tip clearance structure, thus reducing the clearance leakage at the trailing-edge portion, and reducing the influence of a leakage flow on a secondary flow and a vortex structure of a tip flow field.
3. Starting from changing the tip clearance structure itself in the present disclosure, the nonuniform tip clearance structure can be achieved by changing an assembly position between the compressor impeller shroud and the compressor impeller body, without additional special materials and working procedures, and the design and manufacturing process cost is low. Moreover, the present disclosure, the deformation situation of the impeller in the operation environment is also taken into account, so that the deformation influence of the compressor impeller body can be reversely suppressed, and the operation safety and stability are improved.

BRIEF DESCRIPTION OF THE DRAWINGS

To describe the technical solutions of the embodiments of the present disclosure or in the prior art more clearly, the following briefly introduces the accompanying drawings required for describing the embodiments. Apparently, the accompanying drawings in the following description show merely some embodiments of the present disclosure, and those of ordinary skill in the art may still derive other drawings from these accompanying drawings without creative efforts.

Figure 1:
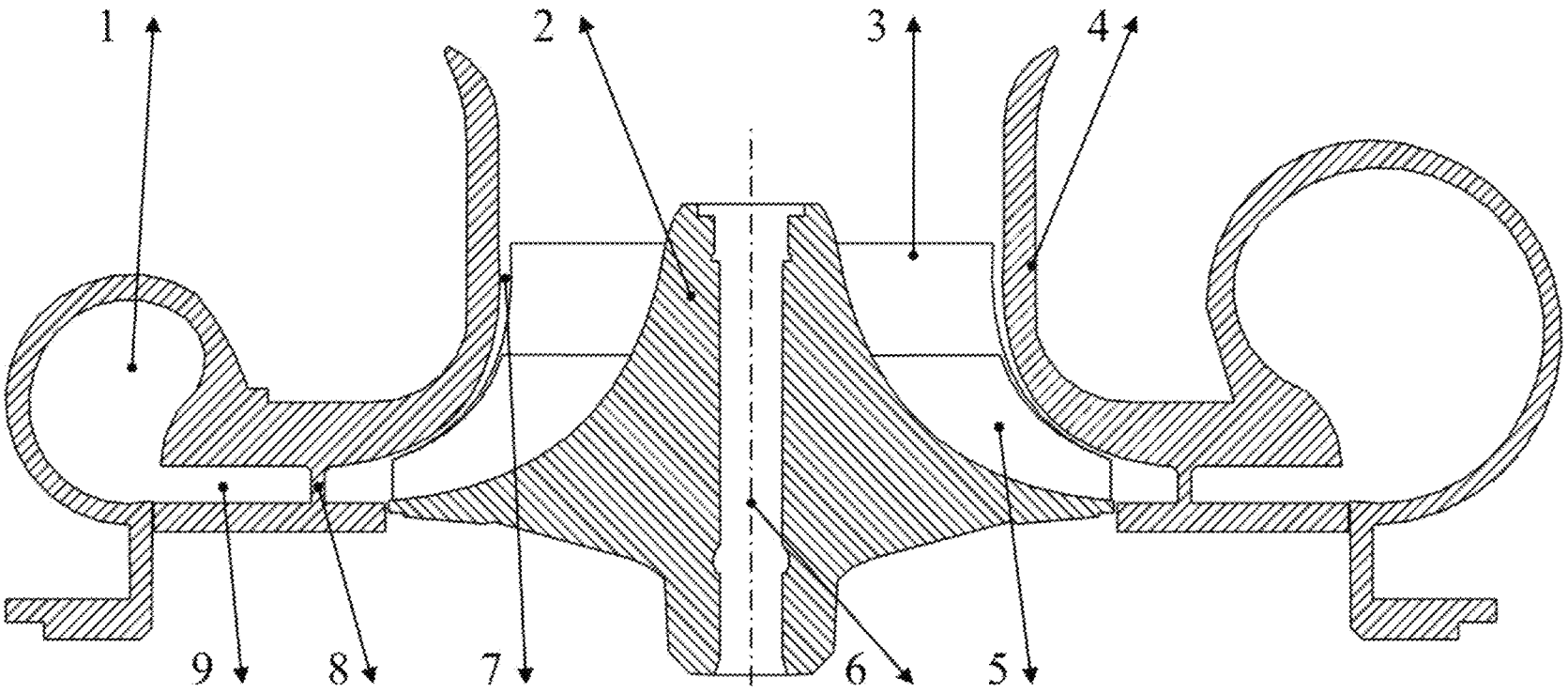
FIG. 1 is a structural schematic diagram of a noise-reducing and nonuniform tip clearance structure of centrifugal compressor according to an embodiment of the present disclosure.

In the drawings: 1-compressor volute passage; 2-compressor impeller hub; 3-main blade body; 4-compressor impeller shroud; 5-splitter blade body; 6-hub rotating shaft; 7-impeller tip clearance; 8-diffuser blade; 9-diffuser passage; 10-impeller shroud meridian line; 11-impeller tip meridian line; $X_L$-leading-edge tip clearance of main blade; $X_T$-trailing-edge tip clearance of main blade; $Y_L$-leading-edge tip clearance of splitter blade; $Y_T$-trailing-edge tip clearance of splitter blade.

DETAILED DESCRIPTION OF THE EMBODIMENTS

The following clearly and completely describes the technical solutions in the embodiments of the present disclosure with reference to the accompanying drawings in the embodiments of the present disclosure. Apparently, the described embodiments are merely a part rather than all of the embodiments of the present disclosure. All other embodiments obtained by a person of ordinary skill in the art based on the embodiments of the present disclosure without creative efforts shall fall within the protection scope of the present disclosure.

An objective of the present disclosure is to provide a noise-reducing and nonuniform tip clearance structure of centrifugal compressor to solve the problems in the prior art, which can effectively solve aerodynamic noise caused by an impeller tip clearance.

In order to make the objectives, features and advantages of the present disclosure more clearly, the present disclosure is further described in detail below with reference to the embodiments.

Figure 2:
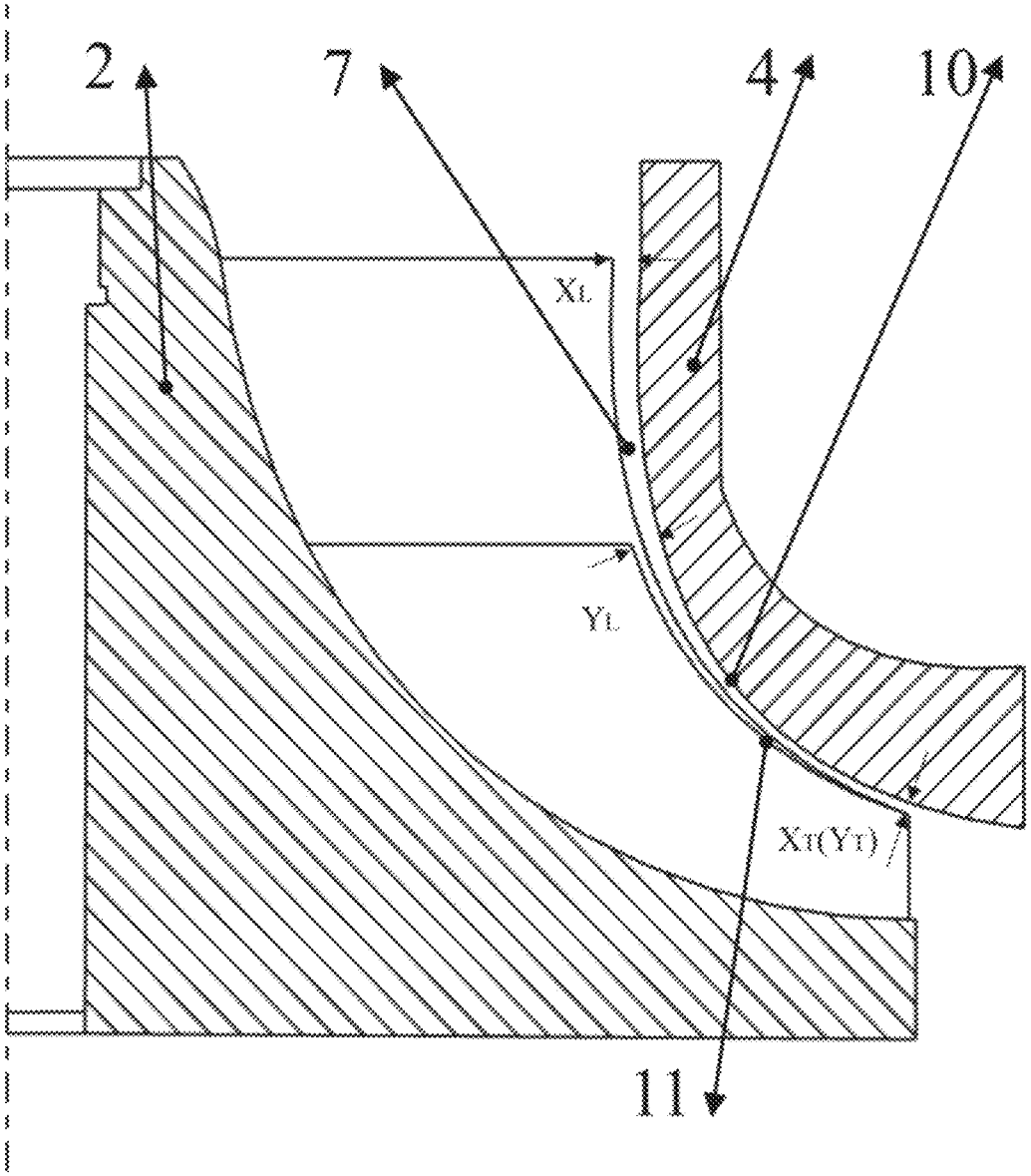
FIG. 2 is a partial enlarged view of a tip clearance in a noise-reducing and nonuniform tip clearance structure of centrifugal compressor according to an embodiment of the present disclosure.

As shown in FIG. 1 to FIG. 6, a noise-reducing and nonuniform tip clearance structure of centrifugal compressor is provided by the present disclosure, including a compressor impeller body and a compressor impeller shroud 4. The compressor impeller shroud 4 is circumferentially wrapped outside the compressor impeller body, and the compressor impeller shroud 4 and the compressor impeller body can rotate relative to each other. Multiple impeller blade bodies are uniformly arranged in a circumferential direction of the compressor impeller body, and a clearance between an impeller tip meridian line 11 on the impeller blade body and an impeller shroud meridian line 10 on the impeller shroud 4 is an impeller tip clearance 7. The impeller tip meridian line 11 about the impeller blade body is as shown in FIG. 2, and a meridional plane of the impeller blade body is shown in FIG. 2. In FIG. 2, the rightmost arc of the impeller blade body is the impeller tip meridian line 11 of the impeller blade body. It is not difficult to see from FIG. 2 that the impeller tip clearance 7 gradually decreases in a direction from a leading edge to a trailing edge of the impeller blade body, and more importantly, a change rate of the impeller tip clearance 7 gradually decreases in the direction from the leading edge to the trailing edge of the impeller blade body, and thus the impeller tip clearance 7 changes nonuniformly.

The nonuniform change of the impeller tip clearance 7 is researched and designed based on the following two existing problems.

1. The existing impeller tip clearance 7 has an adverse effect on the compressor, mainly because of the pressure difference between two sides of the impeller blade, which may produce radial backflow from the trailing edge to the leading edge of the blade along the clearance and cross-blade circumferential flow between adjacent passages along clearance. These flows lead to the aggravation of the flow loss inside the impeller (the larger the tail clearance, the greater the flow loss), which makes the flow situation in the impeller passage more complicated and leads to the increase of the rotating noise and vortex noise of the centrifugal compressor. The impeller tip clearance 7 at the trailing edge of the impeller blade body is smaller than that at the leading edge, and the features that the change rate of the impeller tip clearance increases when close to the blade leading edge and decreases when close to the blade trailing edge can remain a middle portion of the impeller blade body at a small impeller tip clearance 7 structure, and reduce the radial backflow from the trailing edge to the leading edge of the impeller blade body and cross-blade circumferential flow between adjacent passages along clearance, thus reducing the noise.
2. Under actual working conditions, the centrifugal compressor impeller is deformed due to the influence of a centrifugal force, aerodynamic pressure and a thermal load, thus affecting the distribution of the impeller tip clearance 7. According to some existing studies, under the working conditions, the leading-edge tip clearance of a blade of the centrifugal compressor is reduced and the trailing-edge tip clearance is increased. For this reason, the nonuniform impeller tip clearance 7 distribution in the present disclosure can reversely restrain the influence of the deformation of the impeller, and thus improve the operation safety and stability of the compressor.

In this embodiment, multiple impeller blade bodies include multiple main blade bodies 3 and multiple splitter blade bodies 5, that is, the total number of the impeller blade bodies is the sum of the number of the main blade bodies 3 and the number of the splitter blade bodies 5, and the number of main blade bodies 3 is equal to the number of the splitter blade bodies 5. The multiple main blade bodies 3 and the multiple splitter blade bodies 5 are staggered and uniformly distributed.

In this embodiment, the impeller tip clearance 7 needs to satisfy the formula $C=(1+H^4)T$, and related parameter information in the formula is as follows:

in the formula, C is a dimensionless tip clearance height, $$C = \frac{X}{X_L}$$

or $$C = \frac{Y}{Y_L},$$

X is a height of the impeller tip clearance 7 at any normal position of a main blade meridian line, and Y is a height of the impeller tip clearance 7 at any normal position of a splitter blade meridian line; H is a dimensionless blade height coefficient, $$H = \frac{h - H_T}{H_L - H_T}$$

and $H \in [0,1]$, 0 and 1 denote a blade trailing edge and a blade leading edge, respectively; h is a blade height at any normal position between blade meridian lines, $H_L$ is a height of a leading-edge blade, and $H_T$ is a height of a trailing-edge blade; and T is a ratio of a trailing-edge tip clearance to a leading-edge tip clearance, $$T = \frac{X_T}{X_L} = \frac{Y_T}{Y_L},$$

$X_L$ is a leading-edge tip clearance of the main blade, $X_T$ is a trailing-edge tip clearance of the main blade, $Y_L$ is a leading-edge tip clearance of the splitter blade, and $Y_T$ is a trailing-edge tip clearance of the splitter blade.

The blade height is a normal distance of a blade meridian line (i.e., a normal distance from the main blade body 3 or the splitter blade body 5 to a compressor impeller hub 2 in FIG. 2, or a normal distance from the compressor impeller hub 2 to an adjacent impeller tip meridian line 11). The tip clearance is a normal distance between a blade tip meridian line and an impeller shroud meridian line 10.

According to this formula, the tip clearance distribution between the blade leading edge and the blade trailing edge can be obtained. The impeller tip clearance 7 at the blade trailing edge is smaller than that at the blade leading edge, and the impeller tip clearance 7 obtained from this formula increases more when close to the blade leading edge and increases little when close to the blade trailing edge.

A specific implementation mode of a structure of the nonuniform impeller tip clearance 7 in the present disclosure can be based on the known related data of the impeller shroud meridian line 10, and then the impeller tip meridian line 11 of blade of the centrifugal compressor can be calculated according to the distribution law of the impeller tip clearance 7 obtained by the formula.

Alternatively, the distribution law of the impeller tip clearance 7 of the main blade body 3 can also be obtained according to the formula, the splitter blade meridian line is assumed to coincide with the main blade meridian line, and then based on the distribution law of the impeller tip clearance 7, the impeller shroud meridian line 10 is calculated by the known main blade meridian line, thus forming the nonuniform impeller tip clearance 7 structure.

Figure 3:
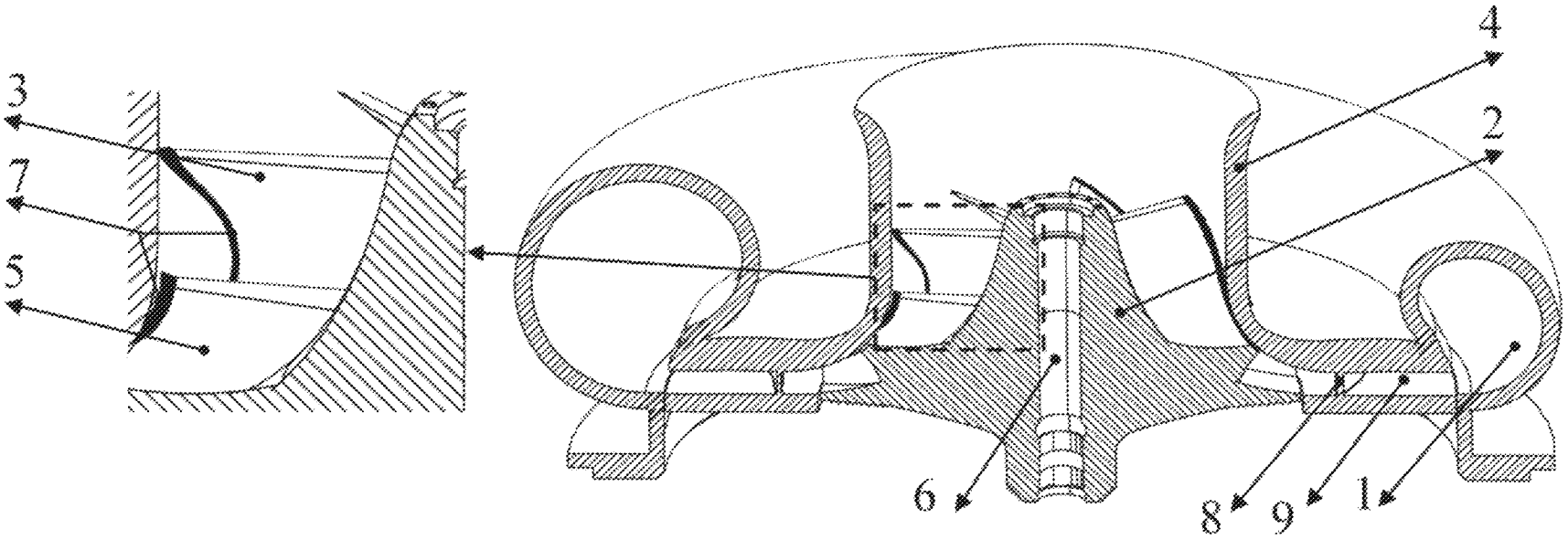
FIG. 3 is a 3D structure schematic diagram of a noise-reducing and nonuniform tip clearance structure of centrifugal compressor according to an embodiment of the present disclosure.
Figure 4:
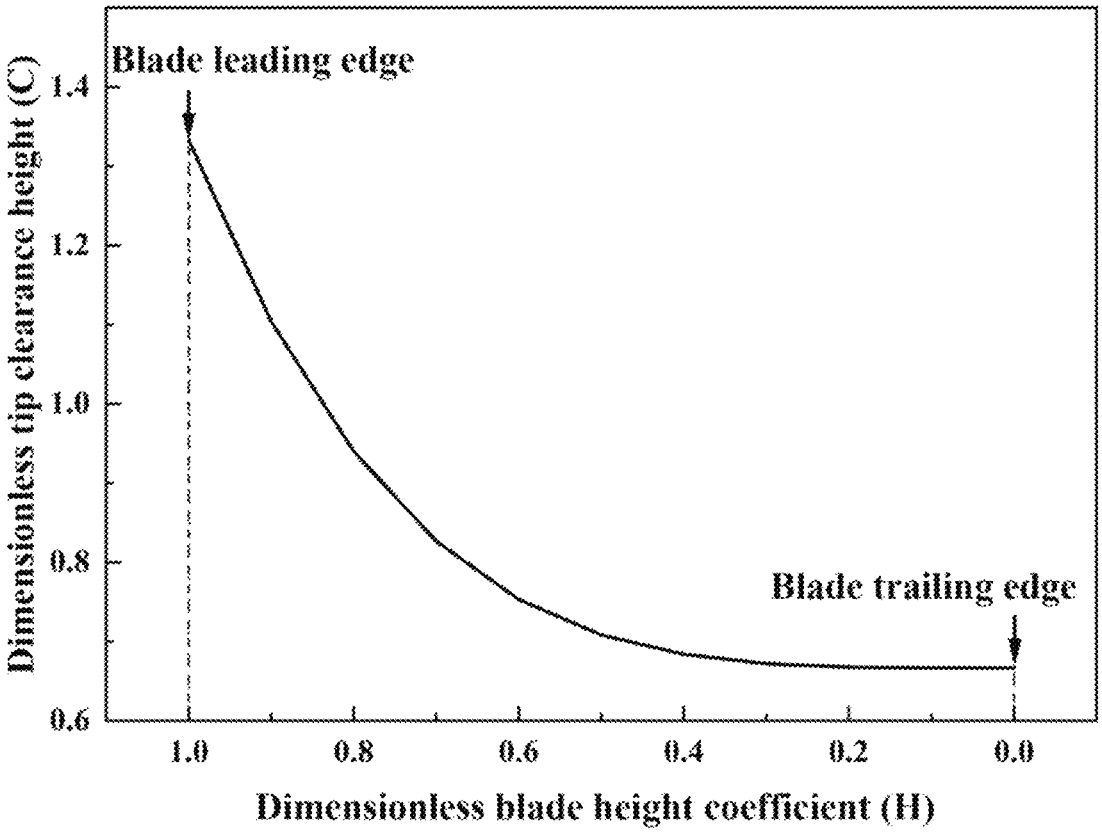
FIG. 4 is a diagram showing the distribution law of a tip clearance from a leading edge to a trailing edge in a noise-reducing and nonuniform tip clearance structure of centrifugal compressor according to an embodiment of the present disclosure.

In this embodiment, as shown in FIG. 2 to FIG. 4, the leading-edge tip clearance $X_L$ of the main blade is equal to 0.975 mm, and the trailing-edge tip clearance $X_T$ of the main blade is equal to 0.65 mm. The leading-edge tip clearance $Y_L$ of the splitter blade is equal to 0.975 mm, and the trailing-edge tip clearance $Y_T$ of the splitter blade is equal to 0.65 mm. The distribution of the nonuniform tip clearance in the present disclosure meets the law: $C=(1+H^4)T$, where a value of T is $$\frac{2}{3}.$$

Based on the impeller shroud meridian line 10, the impeller tip meridian line 11 of the centrifugal compressor is calculated according to the distribution law of the impeller tip clearance 7 obtained by the above formula, so the impeller tip meridian line 11 and the impeller shroud meridian line 10 cooperate with each other to form the nonuniform impeller tip clearance 7.

In order to compare the actual use effects of the present disclosure, a comparative example is provided by the present disclosure. In the comparative example, the uniform tip clearance is 0.65 mm. The tip clearance parameter is only limited to this example, and the specific centrifugal compressor impeller is selected according to its geometric parameters and may be any other value.

Figure 5:
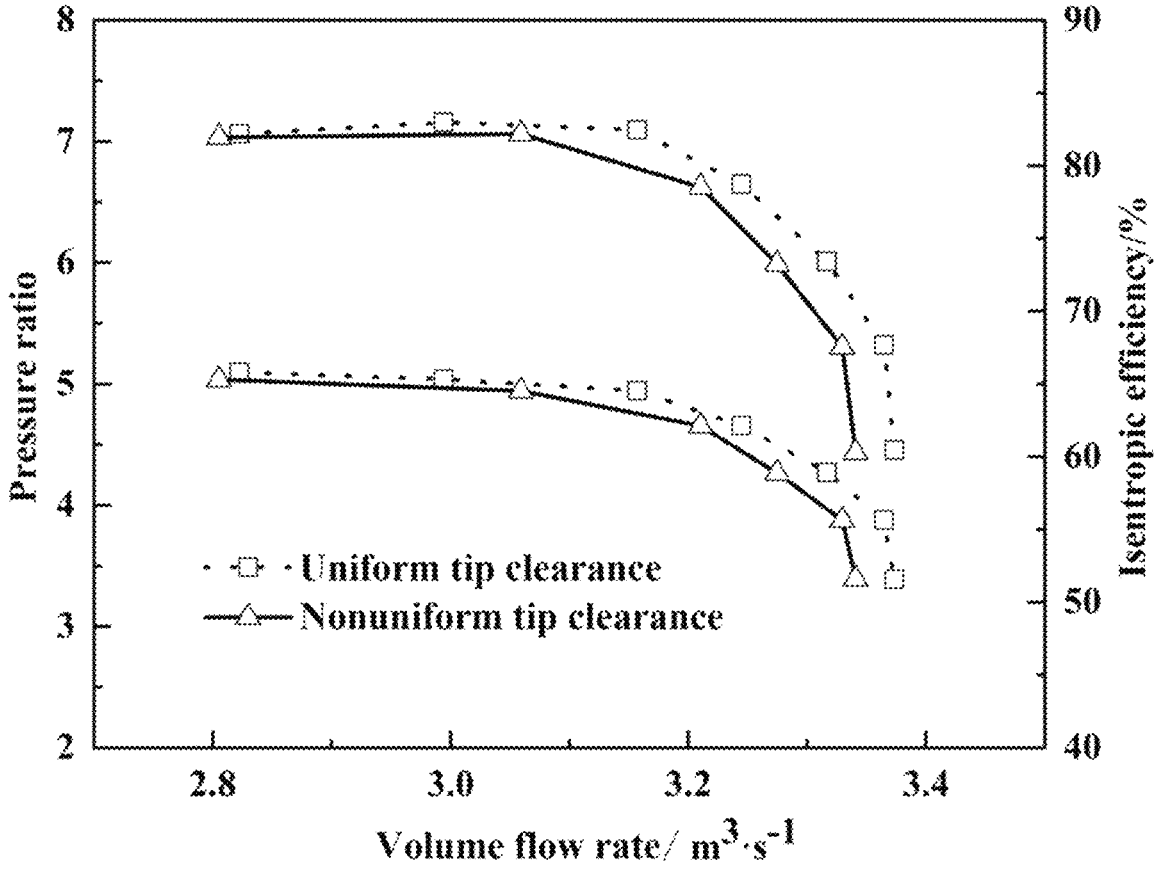
FIG. 5 is a comparison diagram of aerodynamic performance in a noise-reducing and nonuniform tip clearance structure of centrifugal compressor according to an embodiment of the present disclosure.
Figure 6:
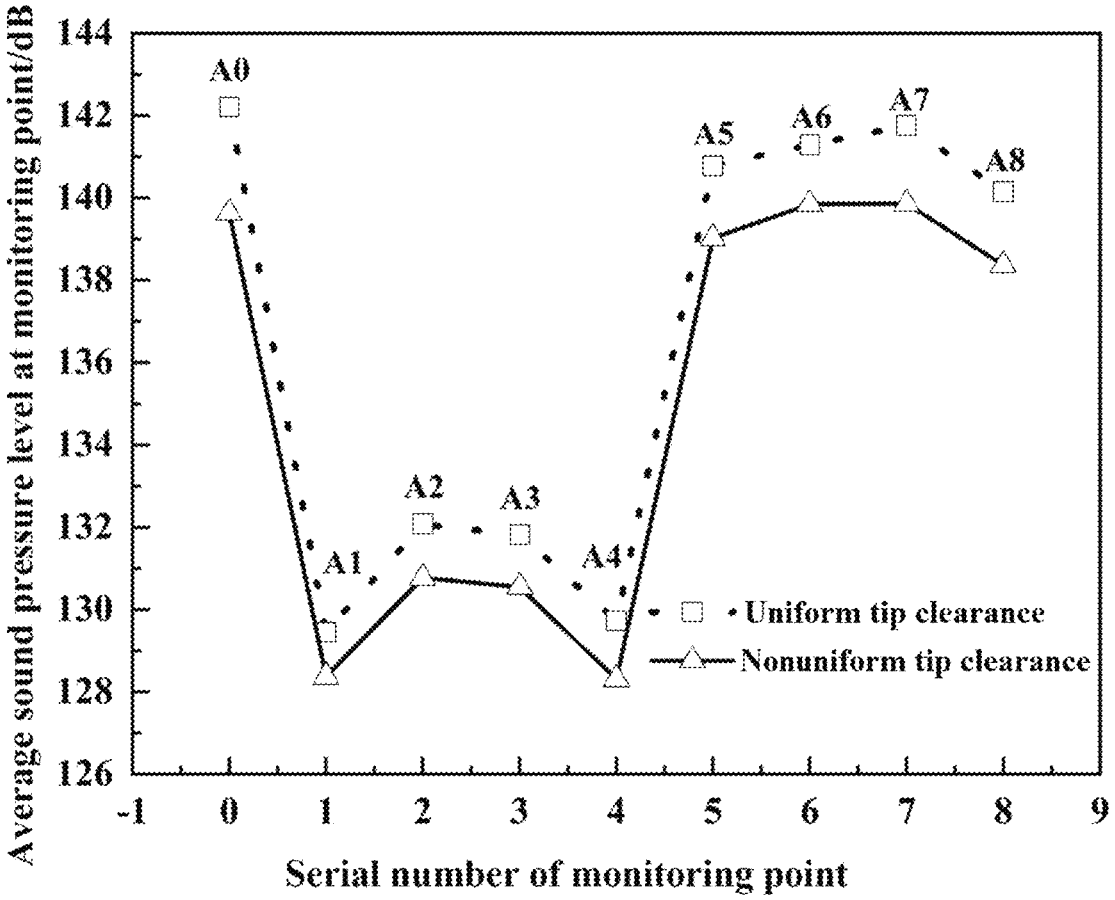
FIG. 6 is a comparison diagram of average sound pressure level of acoustic monitoring points in a noise-reducing and nonuniform tip clearance structure of centrifugal compressor according to an embodiment of the present disclosure.

As shown in FIG. 5 and FIG. 6, on the basis that the overall clearance of the nonuniform impeller tip clearance 7 in this embodiment is larger than the uniform tip clearance, the aerodynamic performance changes little, a pressure ratio and isentropic efficiency are reduced by no more than 2% under a design working condition. For the overall sound pressure level at the same acoustic monitoring point, the nonuniform impeller tip clearance 7 in this embodiment is smaller than the uniform tip clearance 7, and the average overall sound pressure level at the monitoring point is reduced by about 2 dB.

In this embodiment, an exponent of the dimensionless blade height coefficient is n, where n is greater than or equal to 4, in some embodiments n is equal to 5 or 6.

Certainly, a parameter H in the formula can be changed, and the exponent of the dimensionless blade height coefficient H may be other positive number as long as the noise reduction effect required by the present disclosure can be satisfied. Meanwhile, T should be a constant obtained by determining the tip clearances at the trailing edge and leading edge of the blade according to actual needs.

In the present disclosure, it is not limited whether the distribution laws of the impeller tip clearance 7 of the main blade body 3 and the impeller tip clearance 7 of the splitter blade body 5 are the same. That is to say, the main blade meridian line and the splitter blade meridian line may or may not coincide, and generally speaking, the use effect is better when the main blade meridian line does not coincide with the splitter blade meridian line. Certainly, the index of parameter H may also be changed based on the formula $C=(1+H^4)T$ obtained in this embodiment, so as to obtain different impeller tip clearance 7 distribution laws of the main blade body 3 and the splitter blade body 5.

In this embodiment, as shown in FIG. 1, the same with the prior art is that the compressor impeller body includes a compressor impeller hub 2, a hub rotating shaft 6 is fixed to the center of the compressor impeller hub 2, and the hub rotating shaft 6 rotates to drive the compressor impeller hub 2 to rotate synchronously. A volute body is arranged outside the compressor impeller shroud 4, and the compressor impeller shroud 4 and the volute body are in an integrated structure. A compressor volute passage 1 is arranged in the volute body, a diffuser passage 9 is arranged between the compressor volute passage 1 and the compressor impeller body, the diffuser passage 9 is located near the trailing edges of the main blade body 3 and the splitter blade body 5, and a diffuser blade 8 is arranged in the diffuser passage 9.

During actual use, the gas axially enters a compressor impeller passage through an inlet pipe, and the compressor impeller passage is a clearance between the adjacent main blade body 3 and the splitter blade body 5. The hub rotating shaft 6 drives the compressor impeller hub 2, the main blade body 3 and the splitter blade body 5 to rotate. Under the action of a centrifugal force, the main blade body 3 and the splitter blade body 5 are used to compress the gas entering the impeller passage to convert mechanical energy into kinetic energy and pressure energy of the gas. Afterwards, the gas is exhausted at the trailing edges of the main blade body 3 and the splitter blade body 5, and enters the stationary diffuser passage 9 and the volute passage, and the kinetic energy of the gas is further converted into pressure energy, and finally is exhausted from an outlet of the volute body.

Specific examples are used herein for illustration of the principles and embodiments of the present disclosure. The description of the embodiments is merely used to help illustrate the method and its core principles of the present disclosure. In addition, those of ordinary skill in the art can make various modifications in terms of specific embodiments and scope of application in accordance with the teachings of the present disclosure. In conclusion, the content of this specification shall not be construed as a limitation to the present disclosure

What is claimed is:

1. A noise-reducing and nonuniform tip clearance structure of centrifugal compressor, comprising a compressor impeller body and a compressor impeller shroud, wherein the compressor impeller shroud is circumferentially wrapped outside the compressor impeller body, and a plurality of impeller blade bodies are uniformly arranged in a circumferential direction of the compressor impeller body; and a clearance between an impeller tip meridian line of the impeller blade body and an impeller shroud meridian line on the compressor impeller shroud is an impeller tip clearance;

wherein the impeller tip clearance gradually decreases in a direction from a leading edge to a trailing edge of the impeller blade body, and a change rate of the impeller tip clearance in the direction from the leading edge to the trailing edge of the impeller blade body also gradually decreases;

wherein the plurality of impeller blade bodies comprise a plurality of main blade bodies and a plurality of splitter blade bodies, and the plurality of main blade bodies and the plurality of splitter blade bodies are distributed in a staggered manner;

wherein the impeller tip clearance satisfies a formula $C=(1+H^4)T$;

wherein C is a dimensionless tip clearance height, $$C = \frac{X}{X_L}$$

or $$C = \frac{Y}{Y_L},$$

X is a height of the impeller tip clearance at any normal position of a main blade meridian line, and Y is a height of the impeller tip clearance at any normal position of a splitter blade meridian line; H is a dimensionless blade height coefficient, $$H = \frac{h - H_T}{H_L - H_T}$$

and $H \in [0,1]$, 0 and 1 denote a blade trailing edge and a blade leading edge, respectively; h is a blade height at any normal position between blade meridian lines, $H_L$ is a height of a leading-edge blade, and $H_T$ is a height of a trailing-edge blade; and T is a ratio of a trailing-edge tip clearance to a leading-edge tip clearance, $$T = \frac{X_T}{X_L} = \frac{Y_T}{Y_L},$$

$X_L$ is a leading-edge tip clearance of a main blade, $X_T$ is a trailing-edge tip clearance of the main blade, $Y_L$ is a leading-edge tip clearance of a splitter blade, and $Y_T$ is a trailing-edge tip clearance of the splitter blade.

2. The noise-reducing and nonuniform tip clearance structure of centrifugal compressor according to claim 1, wherein the compressor impeller body comprises a compressor impeller hub, a hub rotating shaft is fixed to the center of the compressor impeller hub, a volute body is arranged outside the compressor impeller shroud, and the compressor impeller shroud and the volute body are in an integrated structure; a compressor volute passage is arranged in the volute body; and a diffuser passage is arranged between the compressor volute passage and the compressor impeller body, and a diffuser blade is arranged in the diffuser passage.

* * * * *